US009449480B2

(12) United States Patent
Rumsey

(10) Patent No.: US 9,449,480 B2
(45) Date of Patent: Sep. 20, 2016

(54) SECURITY SYSTEM AND ELECTRICAL CIRCUIT THEREFOR

(71) Applicant: Roger L. Rumsey, Wichita, KS (US)

(72) Inventor: Roger L. Rumsey, Wichita, KS (US)

(73) Assignee: PAIGE ELECTRIC COMPANY, LP, Union, NJ (US)

( * ) Notice: Subject to any disclaimer, the term of this patent is extended or adjusted under 35 U.S.C. 154(b) by 0 days.

(21) Appl. No.: 14/328,327

(22) Filed: Jul. 10, 2014

(65) Prior Publication Data

US 2015/0091734 A1 Apr. 2, 2015

Related U.S. Application Data

(60) Provisional application No. 61/845,527, filed on Jul. 12, 2013.

(51) Int. Cl.
*G08B 1/08* (2006.01)
*G08B 13/14* (2006.01)
*G08B 25/04* (2006.01)

(52) U.S. Cl.
CPC ..... *G08B 13/1454* (2013.01); *G08B 25/04* (2013.01); *G08B 25/045* (2013.01)

(58) Field of Classification Search
CPC .. G08B 25/009; G08B 29/123; G08B 25/04; G08B 25/045; G08B 13/1454
See application file for complete search history.

(56) References Cited

U.S. PATENT DOCUMENTS 3,656,158 A * 4/1972 Goodwater ..... G08B 17/06 340/288
3,699,569 A * 10/1972 Lee ..... G08B 29/02 340/521
4,001,819 A * 1/1977 Wise ..... G08B 29/06 340/521
4,060,803 A * 11/1977 Ashworth, Jr. ..... 340/506
4,148,019 A * 4/1979 Durkee ..... G08B 25/00 340/521
4,176,346 A * 11/1979 Johnson et al. ..... 340/524
4,287,515 A * 9/1981 Raber et al. ..... 340/584
5,172,098 A * 12/1992 Leyden et al. ..... 340/568.2
5,543,782 A * 8/1996 Rothbaum et al. ..... 340/568.2
5,726,627 A * 3/1998 Kane et al. ..... 340/531
6,049,446 A * 4/2000 Ha et al. ..... 361/58
6,278,365 B1 * 8/2001 Kane et al. ..... 340/531

* cited by examiner

*Primary Examiner* — Van Trieu
(74) *Attorney, Agent, or Firm* — Cook Alex Ltd.

(57) ABSTRACT

A circuit for a security system includes a power circuit, a closed loop detection circuit and an alarm circuit. The detection circuit includes a first loop circuit with an alarm sensor and a second loop circuit with a relay. The alarm circuit provides a plurality of output voltages or signals to at least one alarm device, such as two 120 VAC outputs and two 12 VDC outputs. The alarm circuit is coupled to the relay of the detection circuit, such that an alarm condition sensed by the alarm sensor causes the relay to supply energy from the power circuit to the plurality of outputs to activate at least one alarm device. The security system may be turned on and off by a remote control.

6 Claims, 4 Drawing Sheets

| Fig. 3a |
| --- |
| Fig. 3b |

SECURITY SYSTEM AND ELECTRICAL CIRCUIT THEREFOR

CROSS-REFERENCE TO RELATED PATENT APPLICATION

This non-provisional patent application claims the benefit of U.S. provisional patent application Ser. No. 61/845,527, filed on Jul. 12, 2013.

FIELD OF THE DISCLOSURE

The present disclosure is directed to a closed loop security system and an electrical circuit therefor.

SUMMARY

The closed loop security system is small and compact, and it utilizes low voltage electronic circuitry. The electronic circuitry of the security system includes three different circuit portions.

The first circuit portion is a power circuit. This power circuit can provide either 12 VDC or 120 VAC power. The 120 VAC portion preferably has a 12 VDC battery backup and a charging system for the battery. This circuit provides electrical power for other circuit portions.

The second circuit portion is a closed loop detection circuit. This closed loop detection circuit is a closed loop 12 VDC circuit. Since it is a closed loop circuit, it only sees the potential of the circuit. When this circuit is broken, such as by disconnection or by otherwise breaking of the loop, the circuit only sees resistance and the energy once seen as potential is directed to a warning or alarm circuit.

The third circuit portion is an alarm circuit. This alarm circuit may consist of two sub-circuits. The first sub-circuit includes an arming low VDC circuit which is turned on and off by a remote control. When this sub-circuit is energized by the opening of the closed loop circuit, it opens the energy supply to the alarm circuit. The second sub-circuit is an alarm circuit which may include two 120 VAC outlets, two 12 VDC outlets and an audio alarm such as a high pitched/load screeching horn. Other outlets may be added, as desired, such as a phone port and/or a USB port. By having these outlet ports, the end user can select the deterrents of his/her choice, such as a continuous 120 VAC or a visual alarm powered by 120 VAC, such as a flashing device, or a continuous 12 VDC or a visual alarm powered by 12 VDC such as a flashing device.

In summary, the closed loop security system includes a power circuit, a detection circuit which includes a first loop circuit with an alarm sensor and a second loop circuit with a relay, and an alarm circuit with a plurality of alarm outputs for supplying voltages or signals to at least one alarm device. The detection circuit further includes a first resistor in series with the alarm sensor in the first loop circuit and a second resistor is in series with the relay in the second loop circuit, with the second resistor selected to have higher resistance than the first resistor. The detection circuit may be activated or deactivated by a remote controller. A battery is coupled between the first loop circuit and the second loop circuit of the detection circuit to provide current to the first and second loop circuits and a trickle charger continually charges the battery The alarm circuit is coupled to the relay of the detection circuit such that an alarm condition sensed by the alarm sensor causes the relay to supply energy from the power circuit to the plurality of outputs to activate at least one alarm device. The plurality of outputs includes at least two voltages and signals selected from the group including 12 volts DC, 120 volts AC, a flashing 12 volt DC signal, and a flashing 120 volts AC signal. The alarm circuit may further include a switching circuit to provide the flashing output signals.

DETAILED DESCRIPTION OF THE EMBODIMENTS

Figure 1:
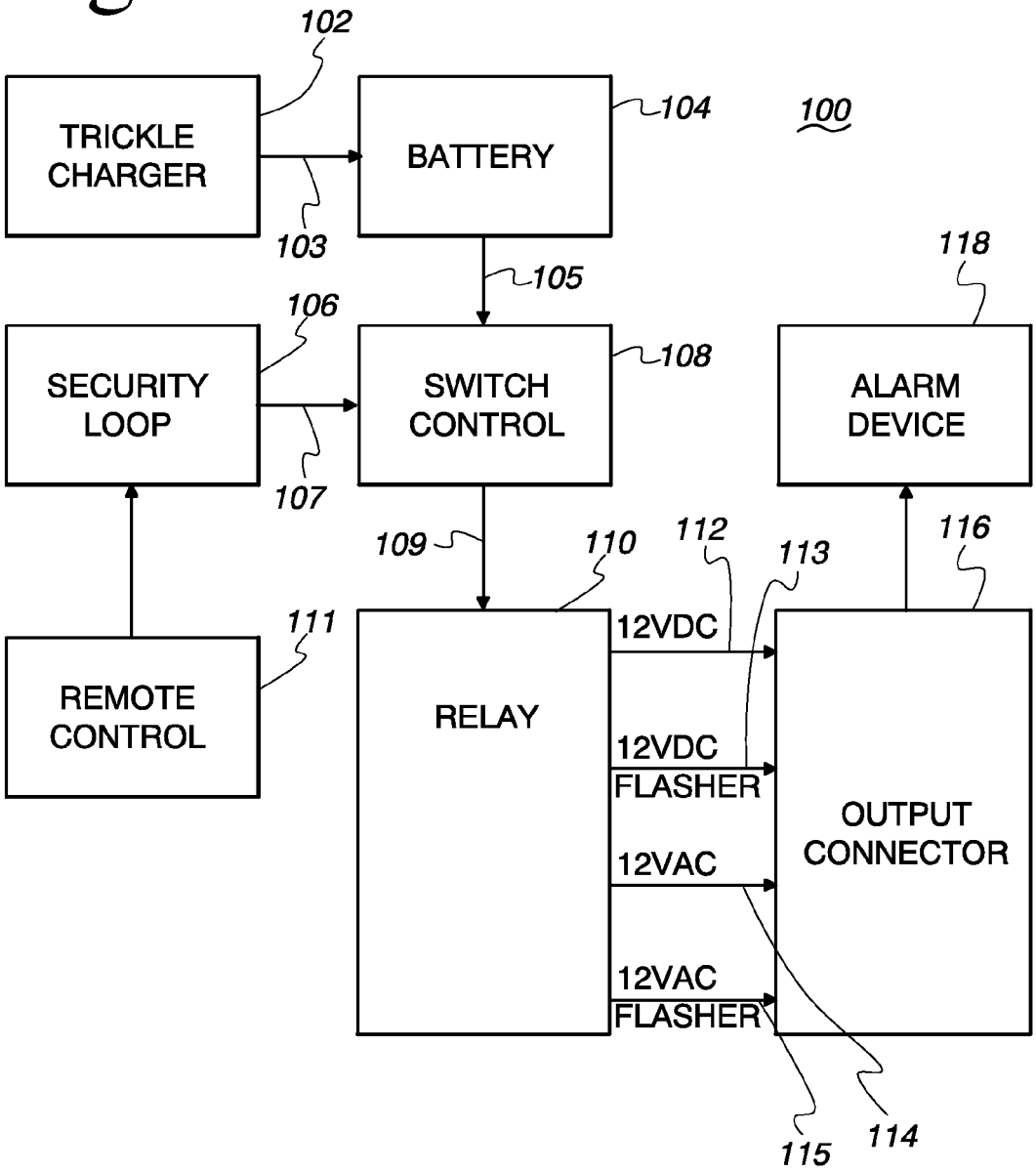
FIG. 1 is a block diagram of the closed loop security system of the present disclosure.

FIG. 1 illustrates a simplified block diagram of a security system, generally designated 100. When energized or activated, a security loop 106 continuously monitors the system for any alarm conditions. When an alarm condition occurs, the security loop provides a signal on line 107 to a switch control 108. Switch control 108 may receive electrical power from a battery 104, such as a 12 VDC battery, via line 105. Battery 104 may be kept in a continually charged state by a trickle charger 102 which provides charge via line 103.

When switch control 108 receives an alarm signal from security loop 106, a relay 110 is energized via a signal on line 109 from the switch control. Relay 110 then provides a plurality of alarm output voltages and output signals. For example, relay 110 may provide a continuous 12 VDC output voltage on output line 112, a flashing 12 VDC output signal on output line 113, a continuous 120 VAC output voltage on output line 114, and/or a flashing 120 VAC output signal on output line 115. All of these output voltages and output signals may be provided at an output connector 116. Thus, the user may connect the desired or appropriate alarm device 118 to the applicable output terminal on connector 116. For example, the flashing output signals on lines 113 and 115 may be used to provide a visual flashing alarm or an audible flashing alarm, and the continuous output signals on lines 112 and 114 may be used to provide a continuous visual alarm or a continuous audible alarm. Of course different combinations of these flashing and/or continuous output signals may be utilized by employing multiple alarm devices, as desired, to provide a plurality of visual and/or audible alarms from the same security system 100.

A remote control 111 may be used to remotely activate or deactivate the security system 100. For example, the remote control may provide a radio frequency (RF) signal, an infrared signal, or other suitable signal to the security loop 106.

Figure 2:
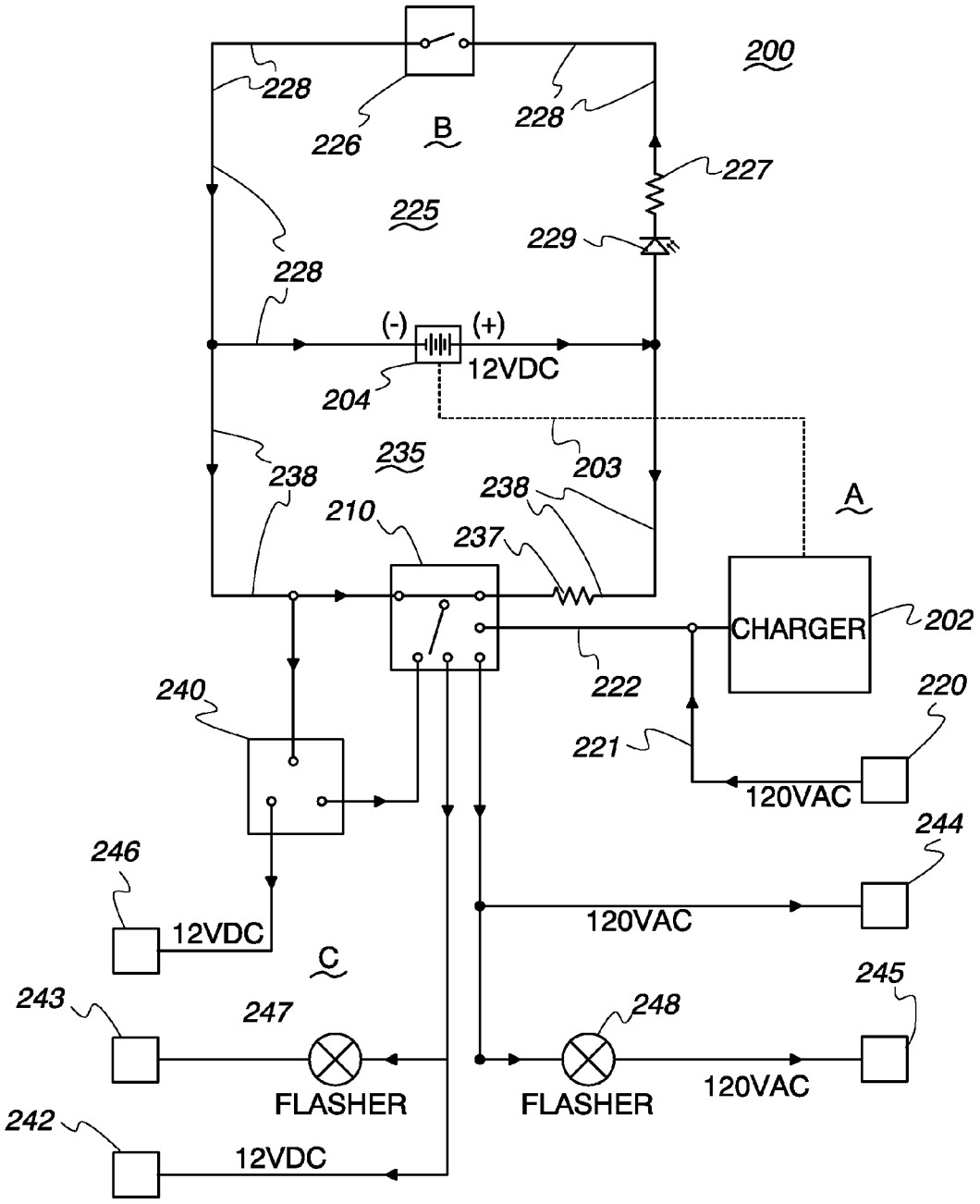
FIG. 2 is an exemplary circuit diagram of the closed loop security system shown in FIG. 1.

FIG. 2 illustrates a circuit diagram for a closed loop security system 200. The security system consists of three sub-circuits. A sub-circuit labeled "A" is the primary power source, a sub-circuit labeled "B" is the arming/detection circuit and a sub-circuit labeled "C" is the alarm circuit. The power source A includes a 120 VAC input at input terminal 220 and a battery charger 202. The 120 VAC on line 221 powers a charger 202, which may be similar to trickle charger 102 in FIG. 1. Charger 202 charges the battery 204 through a line 203. The 120 VAC on line 221 is also supplied to a relay 210 via a line 222.

The arming/detection circuit B includes two loop circuits. A first loop circuit, generally designated 225, consists of line segments 228 which interconnect the battery 204, a switch 226, a resistor 227 and a light emitting diode (LED) 229. LED 229 may be a status indicator for the system and resistor 227 is preferably a low resistive value. A second loop circuit, generally designated 235, consists of line segments 238 which interconnect the battery 204, a resistor 237 and the relay 210. Resistor 237 is preferably a higher resistive value than resistor 227.

The loop circuits 225 and 235 may be formed by a cable physically connected to a plurality of objects, with multiple electrical connectors incorporated in the cable. Such a cable is shown in U.S. patent application Ser. No. 61/760,957, filed Feb. 5, 2013, the disclosure of which is incorporated herein by reference in its entirety. If such a cable is disrupted in an unintended manner, the circuit opens. This is indicated in FIG. 2 schematically by the switch 226. For example, if the loop circuit 225 is protecting store inventory and an unauthorized person tries to remove a piece of that inventory, the electrical continuity of the cable is broken and the switch 226 opens. This energizes the loop circuit 235, which includes the higher value resistor 237 and the relay 210. Energization of relay 210 supplies power to several potential outputs in the alarm sub-circuit C. It also energizes another relay 240 thereby changing the state of its contacts.

The alarm circuit, designated C, in FIG. 2 provides a plurality of alarm output voltages and signals to activate different types of alarms which may operate with DC or AC voltages. For example, continuous 12 VDC may be provided at output terminal 242, and a flashing 12 VDC signal may be provided at an output terminal 243 and to a flashing alarm device 247. In a similar manner, continuous 120 VAC may be provided at output terminal 244, and a flashing 120 VAC signal may be provided at an output terminal 245 and to a flashing alarm device 248. Yet another continuous 12 VDC may be provided at an output terminal 246 from another relay 240. Thus, the system 200 is compatible with, and is capable of energizing, a broad range of different types of security devices and alarm devices.

The system 200 in FIG. 2 operates as follows. With switch 226 in sub-circuit B closed, and the power sub-circuit A energized, the system 200 is armed. If or when the closed loop in sub-circuit B becomes open due to an alarm condition, relays 210 and 240 become energized which provides energy at the output terminals 242-246 of the alarm sub-circuit C. The alarm sub-circuit C can operate a number of different security devices and alarm devices such as sirens, constant on or flashing 12 VDC devices, and constant on or flashing 120 VAC devices. The alarm sub-circuit can also energize a number of different types of security accessories, including lights, cameras, computers, or the like.

The system 200 may further, or alternatively, include a 120 VAC input, key lock ON/OFF and the ability to be connected directly to an output of a 12 VDC power supply. Secondary circuits may be added to include a 12 VDC 20 ma output for security such as closed circuit, a 12 VDC 20 ma output for a battery charger, a 12 VDC 3A secondary output, two 120 VAC secondary outputs, a USB port secondary for connection to other security devices, and operation of an LED in more than one color such as green for ON and red for OFF.

When the system is ON, and the 12 VDC 20 ma circuit is closed, the only secondary operations working are the 12 VDC 20 ma battery charging system. When the 12 VDC 20 ma circuit is opened, all circuits are energized. Should the 120 VAC circuit be opened by means other than a key lock, then the battery may energize a screech siren.

Figure 3A:
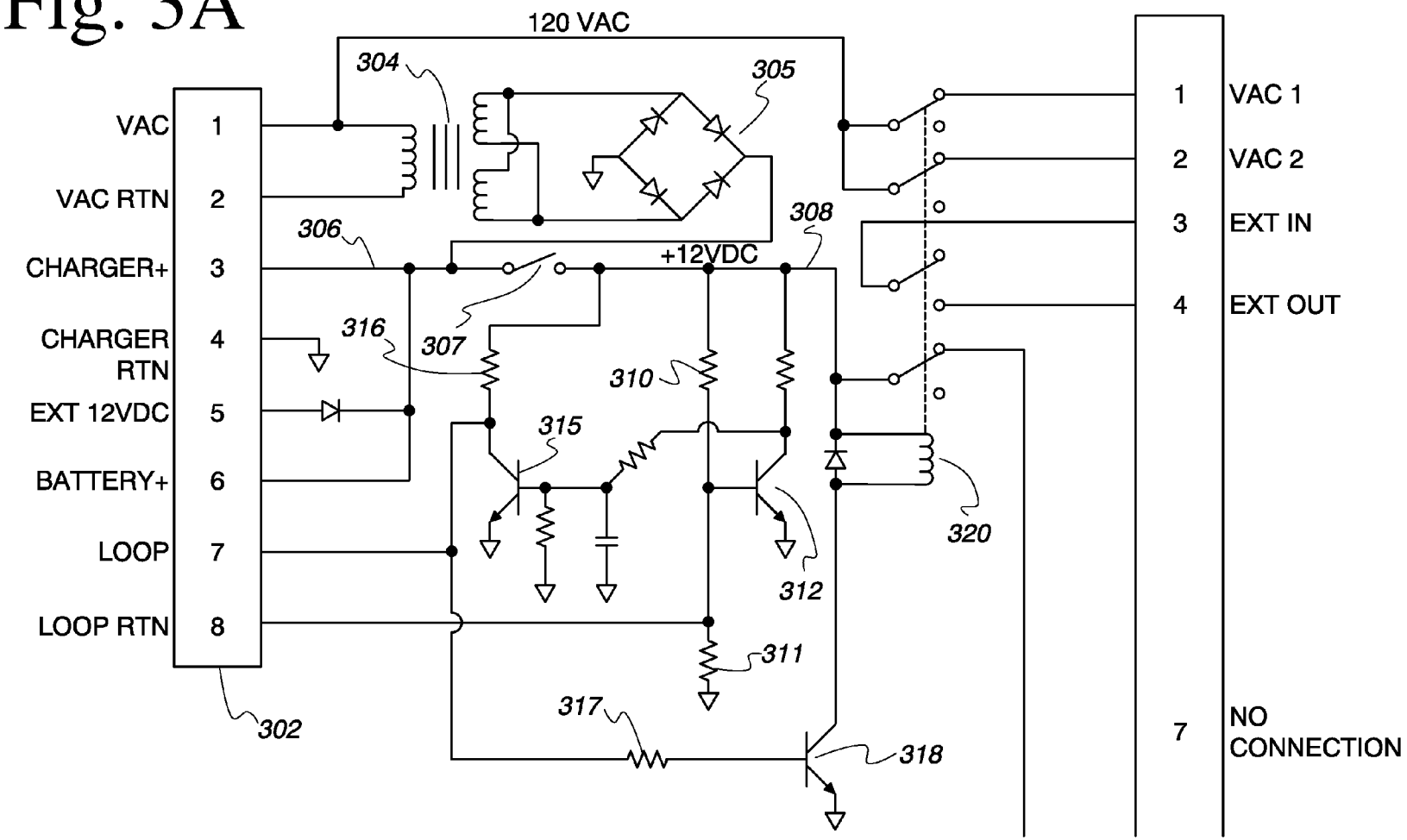
FIG. 3A is an upper portion of a more detailed circuit diagram of the closed loop security system than the circuit diagram shown in FIG. 2.
Figures 3B, 4:
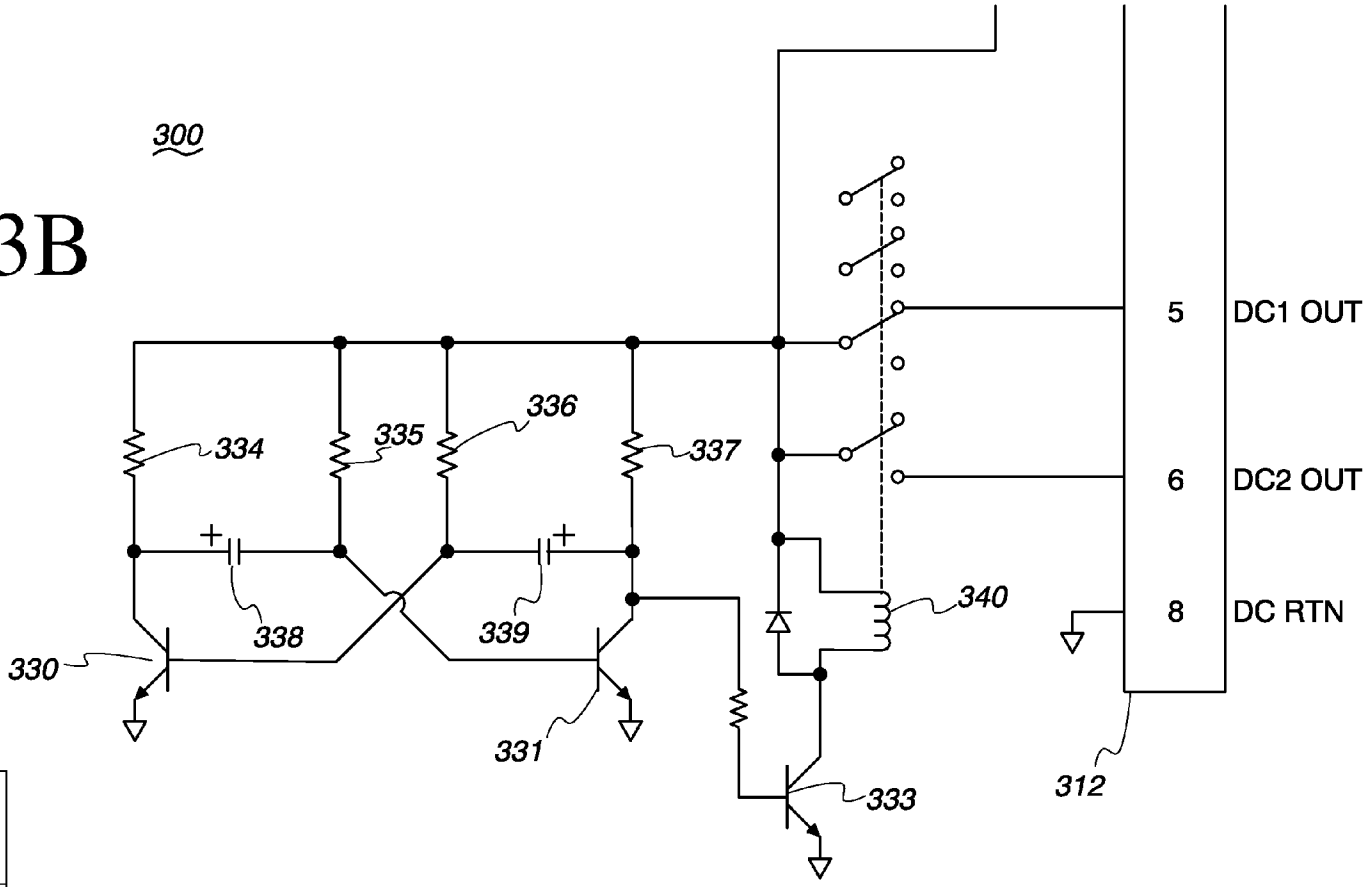
FIG. 3B is a lower portion of a more detailed circuit diagram of the closed loop security system than the circuit diagram shown in FIG. 2.
FIG. 4 is a sketch indicating how the circuit diagrams of FIGS. 3A and 3B would be joined together to make one, combined circuit diagram of the entire circuit.

FIGS. 3A and 3B illustrate another embodiment of a closed loop security system, generally designated 300. It will be understood that FIGS. 3A and 3B are to be combined in the manner illustrated in FIG. 4 to form the complete circuit diagram. System 300 includes an input connector 302 for receiving various voltages, charger current, battery and the like. An output connector 312 provides various AC and DC output signals and voltages, such as for activating various types of alarms, and for providing alarm information to accessories such as lights, cameras, computers, or the like. A transformer 304 has its input terminals connected to the AC voltage input at terminals 1 and 2 of input connector 302. The output terminals of transformer 304 are connected to a full-wave diode rectification bridge 305 to provide 12 VDC at line 306.

When a switch 307 is closed, the 12 VDC is supplied to various portions of the circuitry. Resistors 310 and 311 will then bias a transistor 312 into a conductive state, which will shunt base current away from transistor 315 and render transistor 315 nonconductive. When transistor 315 is nonconductive, transistor 318 receives base drive current through resistors 316 and 317 thereby rendering transistor 318 conductive and energizing relay 320. If and when an alarm condition occurs, as represented in FIG. 3 as the opening of switch 307, the 12 VDC on line 308 drops to zero. Thus, transistor 318 is then nonconductive and relay 320 is un-energized, which will provide alarm condition output signals and voltages at output terminals 1-4 of output connector 312.

In FIG. 3B, a pair of transistors 330 and 331 is connected in a circuit arrangement by resistors 334-337 and capacitors 338 and 339 to form a bistable multivibrator. Depending upon the choice of the resistive and capacitive values, this circuit will switch at a desired frequency and provide a flashing signal for the system 300. The collector terminal of transistor 331 is coupled to the base terminal of transistor 333. Thus, transistor 333 will switched on and off to energize and de-energize a relay 340 at the flashing frequency and provide alarm flashing signal output signals at output terminals 5 and 6 of output connector 312.

It should be understood that various changes and modifications to the presently preferred embodiments described herein will be apparent to those skilled in the art. Such changes and modification can be made without departing from the spirit and scope of the invention disclosed herein.

The invention claimed is:

1. A closed loop security system comprising:

a power circuit;

a detection circuit, the detection circuit including a first loop circuit with an alarm sensor and a second loop circuit with a relay; and an alarm circuit with a plurality of alarm outputs for supplying voltages or signals to at least one alarm device, the alarm circuit coupled to the relay of the detection circuit, whereby an alarm condition sensed by the alarm sensor causes the relay to supply energy from the power circuit to the plurality of outputs to activate at least one alarm device.

2. The closed loop security system of claim 1 wherein the plurality of outputs includes at least two voltages and signals selected from the group including constant voltage DC, constant potential AC, a pulsing voltage DC signal, and a pulsing voltage AC signal.

3. The closed loop security system of claim 1 further comprising;

a battery coupled between the first loop circuit and the second loop circuit of the detection circuit to provide current to the first and second loop circuits.

4. The closed loop security system of claim 3 further comprising:

a trickle charger to continually charge the battery.

5. The closed loop security system of claim 1 further comprising:

a first resistor in series with the alarm sensor in the first loop circuit of the detection circuit; and a second resistor in series with the relay in the second loop circuit of the detection circuit, the second resistor selected to have higher resistance than the first resistor.

6. The closed loop security system of claim 1 wherein the detection circuit is activated or deactivated by a remote controller.

* * * * *